US009243496B2

(12) United States Patent
Jones et al.

(10) Patent No.: US 9,243,496 B2
(45) Date of Patent: Jan. 26, 2016

(54) METHOD AND APPARATUS FOR BULK SEAFLOOR MINING

(75) Inventors: Glen Robert Jones, Milton (AU); Antony Eliot Inglis, Milton (AU); Anthony Paul O'Sullivan, Milton (AU); Michael Howitt, Milton (AU); Glen Smith, Milton (AU); Roland Gunter Berndt, Milton (AU); Daal Hallam Jaffers, Milton (AU); Nicholas William Ridley, Wallsend (GB); Ian Maskell, Wallsend (GB)

(73) Assignee: Nautilus Minerals Pacific Pty Ltd, Milton (AU)

( * ) Notice: Subject to any disclaimer, the term of this patent is extended or adjusted under 35 U.S.C. 154(b) by 123 days.

(21) Appl. No.: 13/805,188

(22) PCT Filed: Jun. 17, 2011

(86) PCT No.: PCT/AU2011/000732
§ 371 (c)(1),
(2), (4) Date: Aug. 1, 2013

(87) PCT Pub. No.: WO2011/156866
PCT Pub. Date: Dec. 22, 2011

(65) Prior Publication Data

US 2013/0298430 A1 Nov. 14, 2013

(30) Foreign Application Priority Data

Jun. 18, 2010 (AU) ..... 2010902668

(51) Int. Cl.
*E02F 5/00* (2006.01)
*E21C 50/00* (2006.01)
(Continued)

(52) U.S. Cl.
CPC . *E21C 50/00* (2013.01); *E02F 3/20* (2013.01); *E02F 3/8866* (2013.01); *E02F 3/9212* (2013.01); *E02F 3/9237* (2013.01); *E21C 45/00* (2013.01)

(58) Field of Classification Search
CPC ..... E02B 3/023; E02F 3/8866; E02F 3/8858; E02F 3/88; E02F 3/9262; E02F 3/9212; E02F 3/905; E02F 3/907; E02F 3/04; E02F 3/081; E02F 3/9237; E02F 3/20; E02F 5/006; E02F 5/109; E02F 7/06; E02F 7/005; E21C 45/00; E21C 50/00
USPC ..... 37/307, 313, 317–322, 324, 326, 337, 37/343; 299/8, 9, 30, 75; 405/190, 191; 175/107
See application file for complete search history.

(56) References Cited

U.S. PATENT DOCUMENTS 3,731,975 A 5/1973 Lindelof
3,738,029 A * 6/1973 Harmon ..... 37/329
(Continued)

FOREIGN PATENT DOCUMENTS

CN 101519967 A 9/2009
DE 19531474 A1 2/1997
(Continued)

OTHER PUBLICATIONS

International Search Report for PCT/AU2011/000732.

*Primary Examiner* — Robert Pezzuto
(74) *Attorney, Agent, or Firm* — McDonnell Boehnen Hulbert & Berghoff LLP

(57) ABSTRACT

A seafloor bulk mining tool for production cutting of a seafloor bench. The tool uses a tracked locomotion system to travel across a seafloor bench. Power and control interfaces receive power and control signals from a surface source. The tool has a drum cutter for cutting the bench, and a sizing grill adjacent the drum cutter for sizing cuttings as they are produced by the drum cutter. A drum shroud may also be provided to help contain cuttings. A suction inlet can be used to capture cuttings as they are produced, for example in conjunction with a spade and augers.

19 Claims, 7 Drawing Sheets

(51) Int. Cl.

| | |
|---|---|
| ***E02F 3/20*** | (2006.01) |
| ***E02F 3/88*** | (2006.01) |
| ***E02F 3/92*** | (2006.01) |
| ***E21C 45/00*** | (2006.01) |

(56) References Cited

U.S. PATENT DOCUMENTS

| | | | | |
|---|---|---|---|---|
| 4,026,376 | A * | 5/1977 | Gee | 180/68.1 |
| 4,037,874 | A | 7/1977 | Willums | |
| 4,104,813 | A * | 8/1978 | Lindsey | 37/319 |
| 4,398,362 | A | 8/1983 | Weinert | |
| 5,651,200 | A * | 7/1997 | Walsh et al. | 37/329 |
| 6,003,952 | A * | 12/1999 | Smart et al. | 299/9 |
| 6,178,670 | B1 * | 1/2001 | Susman et al. | 37/313 |

FOREIGN PATENT DOCUMENTS

| | | | |
|---|---|---|---|
| JP | 59-041597 | A | 3/1984 |
| JP | 62-225631 | A | 3/1987 |
| JP | 2266088 | A | 10/1990 |
| JP | 11117658 | A | 4/1999 |
| WO | 98/42922 | | 10/1998 |

* cited by examiner

Figure 7a
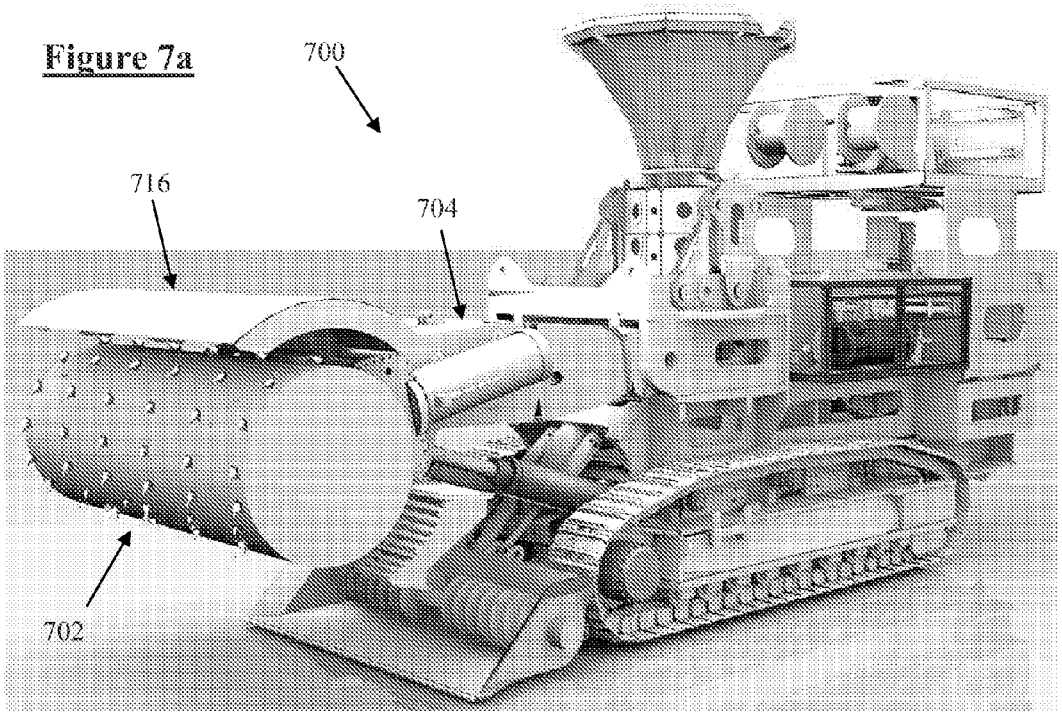
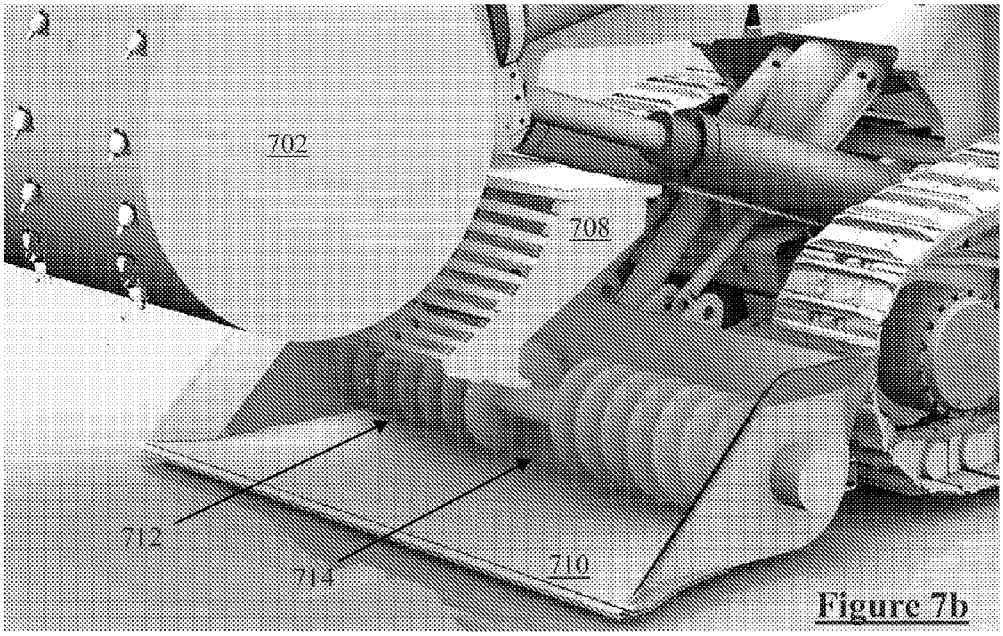
Figure 7b

METHOD AND APPARATUS FOR BULK SEAFLOOR MINING

This application is a U.S. National Phase Application pursuant to 35 U.S.C. §371 of International Application No. PCT/AU2011/000732 filed on Jun. 17, 2011, which claims priority to Australian Patent Application 2010902668, filed Jun. 18, 2010, the disclosures of which are incorporated herein by reference in their entirety.

TECHNICAL FIELD

The present invention relates generally to underwater mining, and in particular relates to a system and method for seafloor mining and gathering using a bulk cutting seafloor tool.

BACKGROUND OF THE INVENTION

Seabed excavation is often performed by dredging, for example to retrieve valuable alluvial placer deposits or to keep waterways navigable. Suction dredging involves positioning a gathering end of a pipe or tube close to the seabed material to be excavated, and using a surface pump to generate a negative differential pressure to suck water and nearby mobile seafloor sediment up the pipe. Cutter suction dredging further provides a cutter head at or near the suction inlet to release compacted soils, gravels or even hard rock, to be sucked up the tube. Large cutter suction dredges can apply tens of thousands of kilowatts of cutting power. Other seabed dredging techniques include auger suction, jet lift, air lift and bucket dredging.

Most dredging equipment typically operates only to depths of tens of meters, with even very large dredges having maximum dredging depths of little more than one hundred meters. Dredging is thus usually limited to relatively shallow water.

Subsea boreholes such as oil wells can operate in deeper water of up to several thousand meters depth. However, subsea borehole mining technology does not enable seafloor mining.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY OF THE INVENTION

According to a first aspect the present invention provides a seafloor bulk mining tool for production cutting of a seafloor bench, the bulk mining tool comprising:

- a tracked locomotion system to enable locomotion of the bulk mining tool across a seafloor bench;
- power and control interfaces to receive power and control signals from a surface source; and
- a drum cutter for cutting a bench; and
- a sizing grill adjacent the drum cutter, for sizing cuttings as they are produced by the drum cutter.

According to a second aspect the present invention provides a method for production cutting of a seafloor bench, the method comprising:

- a seafloor bulk mining tool receiving power and control signals from a surface source;
- the seafloor bulk mining tool locomoting across the seafloor bench; and
- a drum cutter of the seafloor bulk mining tool cutting the bench, and a sizing grill adjacent the drum cutter sizing cuttings as they are produced by the drum cutter.

The seafloor bulk mining tool of the present invention thus advantageously provides for bulk cutting of benches occurring or formed on the seafloor.

In preferred embodiments of the invention, the seafloor bulk mining tool comprises a slurry pump system and a slurry inlet proximal to the cutting drum, configured to capture cuttings from the proximity of the sizing grill in the form of a slurry. The slurry may be pumped a short distance from the seafloor bulk mining tool, for example simply to one side of the path taken or to be taken by the tool, or behind the tool to avoid the tool having to travel over cuttings on the seafloor. Alternatively, the slurry may be pumped to a seafloor stockpile location some distance away from the seafloor mining tool via a suitable transfer pipe.

In preferred embodiments, a collection shroud partially surrounds the cutting drum to optimise containment and collection of cuttings by the slurry pump system.

The sizing preferably sizes cuttings by crushing particles larger than a grill-to-drum distance against the cutter drum.

The seafloor bulk mining tool may be an untethered remotely operated vehicle (ROV) or may be a tethered vehicle operated by umbilicals connecting to the surface.

Further, the present invention provides a tool adaptable in some embodiments to deployment at significant water depths. For example some embodiments may be operable at depths greater than about 400 m, more preferably greater than 1000 m and more preferably greater than 1500 m depth. Nevertheless it is to be appreciated that the tool of the present invention may also present a useful seafloor cutting option in water as shallow as 100 m or other relatively shallow submerged application. Accordingly it is to be appreciated that references to the seafloor or seabed are not intended to exclude application of the present invention to mining or excavation of lake floors, estuary floors, fjord floors, sound floors, bay floors, harbour floors or the like, whether in salt, brackish, or fresh water, and such applications are included within the scope of the present specification.

The bulk mining cutter of the bulk mining tool in some embodiments may comprise an electrically or hydraulically driven cutting drum which trails or leads the tool during locomotion. The cutting drum may be mounted on a boom assembly allowing variable cutting depth, whereby the cutting depth may for example be chosen responsive to a hardness of material in the bench being cut.

The drum cutter of the bulk mining tool is preferably configured to generate cuttings of a desired size. For example, the cuttings may be of a size suitable for gathering in the form of a slurry of water and cuttings. Preferably the drum cut width is greater than the machine track width.

Where the material to be retrieved is of a thickness greater than a bench height, the bench height being defined by the cutting depth of the seafloor bulk mining tool, multiple layers of benches of the material may be removed by multiple bulk mining steps performed by the bulk mining tool of the present invention. Cuttings produced with each pass of the seafloor bulk mining tool may be gathered by a suction inlet of the bulk mining tool during each pass or by other seafloor tools after each pass.

The bulk mining tool's weight is preferably selected such that the tool has sufficient weight when submerged in order that the bulk mining tool may apply sufficient downwards force to enable production cutting of a bench.

The seafloor bulk mining tool is preferably designed to work on a relatively flat and relatively horizontal bench surface and to cut down into the surface to a cutting depth while traversing across the bench surface. Cuttings may be left in place for subsequent gathering by a seafloor gathering tool, or may be gathered by a suction inlet near the cutter drum during cutting and delivered away from the tool. The seafloor bulk mining tool preferably cuts substantially an entire bench by traversing the surface of the bench in one or more paths. The cutting paths of the bulk mining tool are preferably optimised to maximise ore recovery from the bench based on the unique bench size and bench shape existing at the seafloor site concerned.

Preferably, the gathering or stockpiling area may be distal from the ore bench, with the bulk mining tool in such embodiments having a slurry pump system or a side cast system or the like for deposition of cut ore in a gathering or stockpiling area. Alternatively, the gathering area into which the cuttings are deposited by the bulk mining tool is the same location as the ore bench, whereby the bulk mining tool cuts the ore without substantially relocating the ore. Such embodiments permit the bulk mining tool design, function and operation to focus on the cutting requirements for such bulk mining, without being complicated by considerations of relocating cuttings.

The bench may comprise an ore bench of valuable ore to be retrieved, or may comprise a bench of hard rock or other seafloor material to be removed for other purposes. The ore may comprise seafloor massive sulphides.

The present invention recognises that seafloor sites of interest can be of complex topography, and the present invention thus provides for multiple seafloor mining tools operating in concert to effect retrieval of the seafloor material.

In this specification, the term "drum cutter" is not intended to encompass cutters of the disc type. Disc cutters being those, for example, which provide a cut which is relatively narrow when compared with the disc cutter diameter.

According to a third aspect the present invention provides a seafloor bulk mining toot for production cutting of a seafloor bench, the bulk mining tool comprising:

- a tracked locomotion system to enable locomotion of the bulk mining tool across a seafloor bench;
- power and control interfaces to receive power and control signals from a surface source; and
- a drum cutter positioned aft of the tool during locomotion and configured for cutting a bench during locomotion across the bench and for leaving cuttings on the seafloor for subsequent gathering.

According to a fourth aspect the present invention provides a method for production cutting of a seafloor bench, the method comprising:

- a seafloor bulk mining tool receiving power and control signals from a surface source;
- the seafloor bulk mining tool locomoting across the seafloor bench; and
- a drum cutter of the seafloor bulk mining tool cutting the bench, the drum cutter being positioned aft of the tool during locomotion and leaving cuttings on the seafloor for subsequent gathering.

The third and fourth aspects of the invention may permit improved cutting efficiency and therefore a faster mining rate, as compared to a bulk cutter which gathers its own cuttings.

Some embodiments of the third and fourth aspects of the invention may comprise a sizing grill proximal to the cutting drum to size cuttings produced by the cutting drum, however in other embodiments a sizing grill may be omitted.

BRIEF DESCRIPTION OF THE DRAWINGS

An example of the invention will now be described with reference to the accompanying drawings, in which:

FIGS. 7*a* and 7*b* illustrate a bulk mining tool in accordance with another embodiment of the invention.

DESCRIPTION OF THE PREFERRED EMBODIMENT

Figure 1:
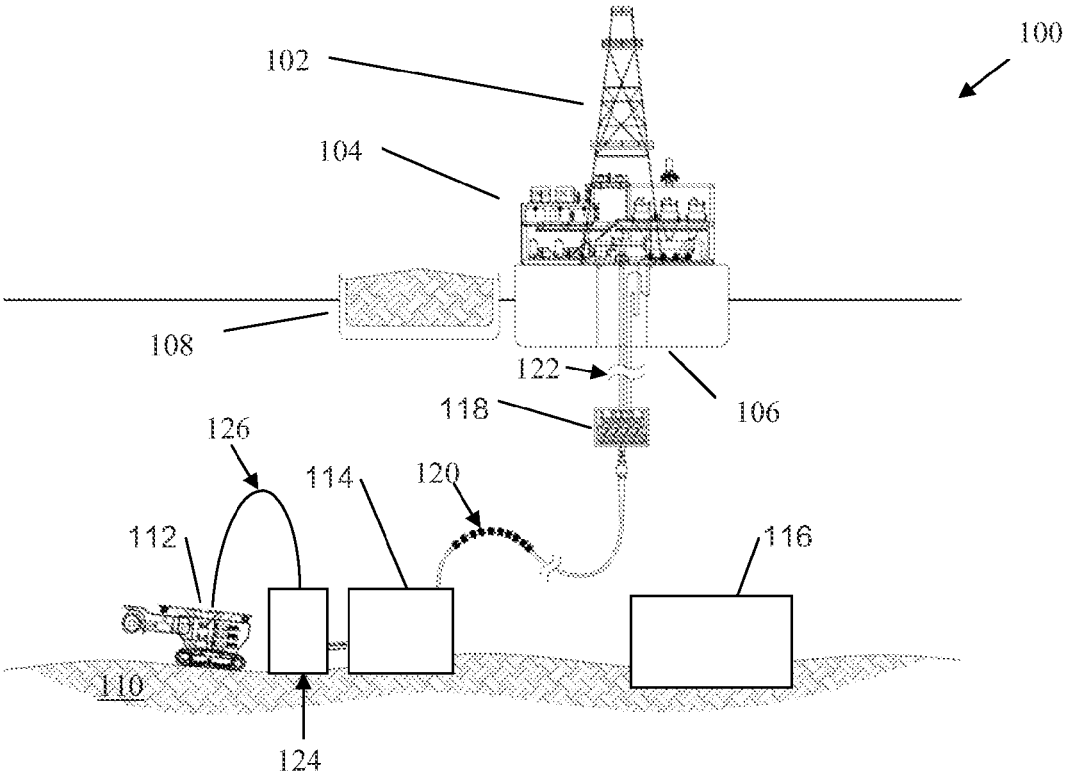
FIG. 1 is a simplified overview of a subsea system in accordance with one embodiment of the present invention.

FIG. 1 is a simplified overview of a subsea system 100, incorporating a bulk mining machine 112 in accordance with one embodiment of the present invention. A derrick 102 and dewatering plant 104 are mounted upon an oceangoing production support vessel (PSV) 106. The PSV 106 has ore transfer facilities to load retrieved and dewatered ore onto barge 108. The present embodiment provides a tool 112 operable to 2500 m depth, however alternative embodiments may be designed for operation from 100 m to 3000 m depth or greater. During production operations, seafloor mining tools (SMTs) will be used to excavate ore from the seabed 110. The SMTs comprise a seafloor bulk mining machine 112, a seafloor gathering machine 114, a seafloor auxiliary mining machine 116 and a seafloor stockpiling device 126.

Ore mined by the bulk mining machine (BM) 112 and auxiliary mining machine (AUX) 116 is pumped into stockpile 124 via stockpile transfer pipe 126. Ore in stockpile 124 is gathered by gathering machine 114 and pumped, in the form of slurry, through a riser transfer pipe (RTP) 120 to the base of the riser 122. A subsea lift pump 118 then lifts the slurry via a rigid riser 122, which is shown interrupted in FIG. 1 and may be up to 2500 m long in this embodiment. The slurry travels to the surface support vessel 106 where it is dewatered by plant 104. The waste water is returned under pressure back to the seafloor to provide charge pressure for the subsea lift pump 118. The dewatered ore is offloaded onto transport barge 108 to be transported to a stockpile facility before being transported to a processing site.

Figure 2A:
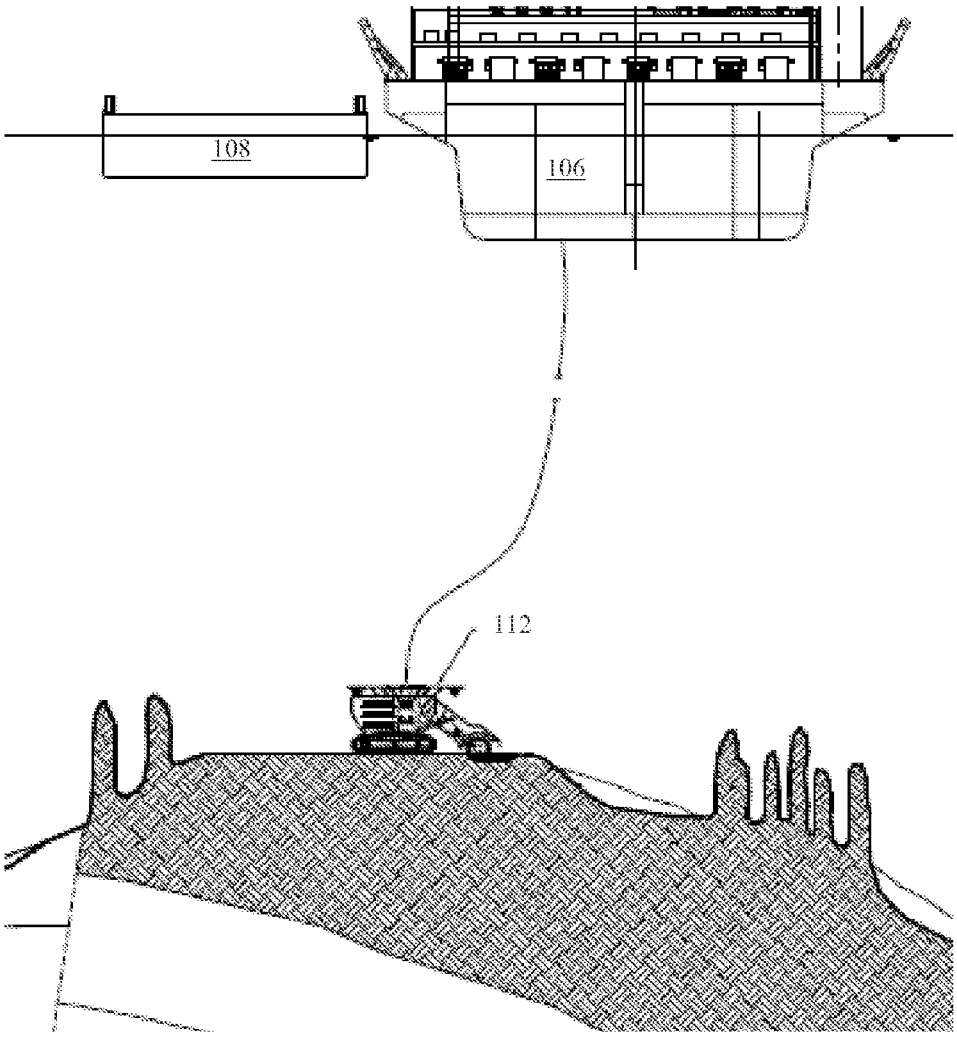
FIGS. 2*a* and 2*b* illustrate operation of a bulk miner in accordance with one embodiment of the present invention.

The BM 112 cuts a bench while progressing across the bench, and makes one or more traversals back and forth across the bench in order to cut substantially the entire area of the bench. The BM 112 may further make additional passes across or perpendicular to the original traversals in order to more closely trim the edges of the bench. FIG. 2*a* illustrates the seafloor mining environment during a first bench cutting stage.

Figure 2B:
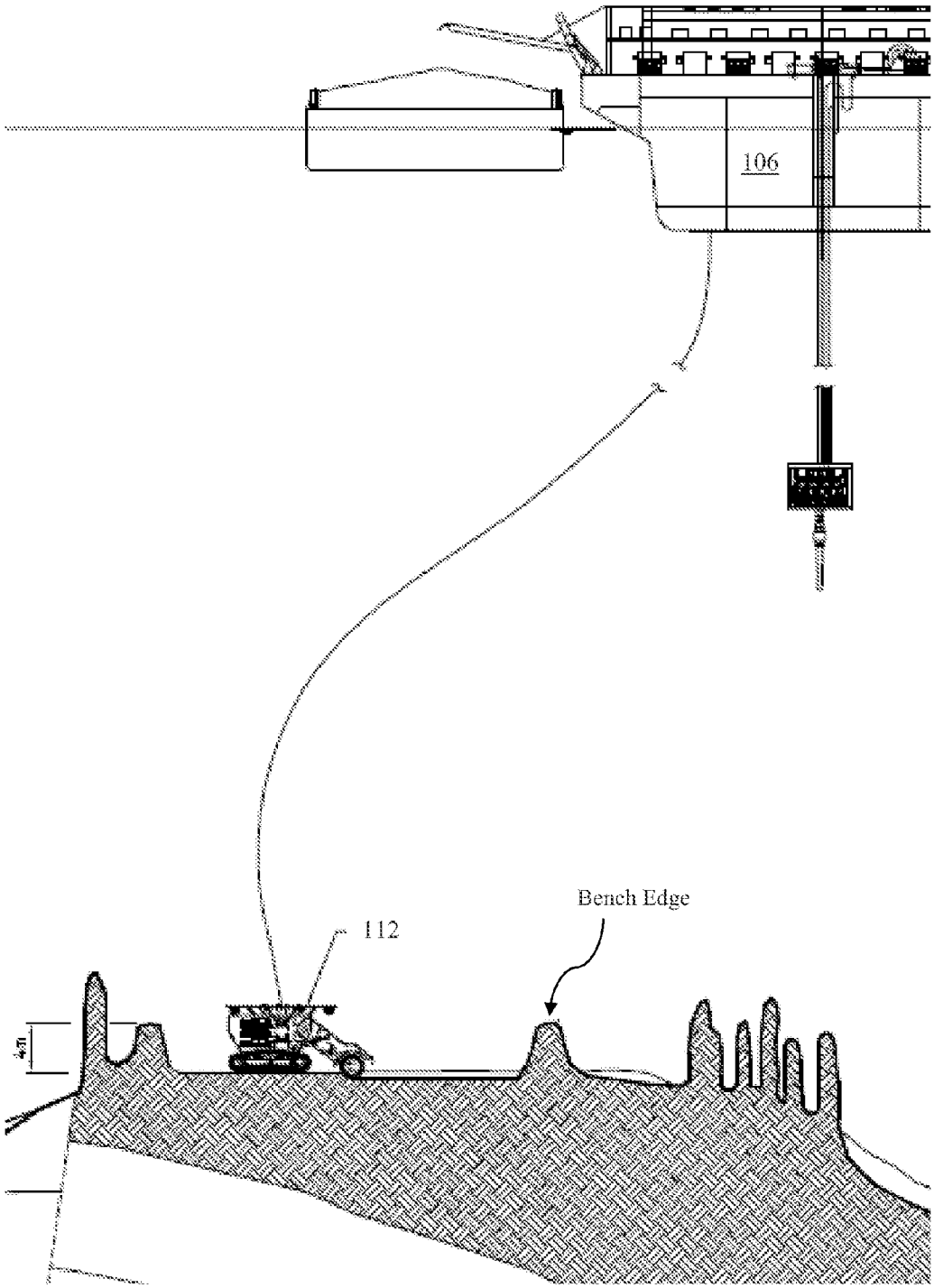

Given the bulk mining role of the BM 112 it is expected that some portion of the bench, particularly at lateral extremities and footwalls where the BM 112 must maintain a safety margin as well as have room to turn around to begin a new traversal of the bench, will not be fully cut by the BM 112. This is shown in FIG. 2*b*, in which the bench edges are about 4 m high after cutting of multiple benches.

The BM 112 is designed to manoeuvre around the mine site and to cut mineral deposits through remote operator control on the topside Production Support Vessel 106. In this embodiment the BM 112 requires a minimum bench area of about 750 square meters for efficient operation. In alternative embodiments the dimensions of the BM may be of a smaller scale to permit the BM to commence operations upon a bench of area less than 750 square meters, or in other embodiments the BM may be of a larger scale and require a minimum bench size of greater than 750 square meters to commence operation. Benches are then progressively removed from the high point in the manner shown in FIGS. 2*a* and 2*b* so as to recover the mound of ore deposit.

Excavated particle size is controlled by the BM cutter configuration and speed of advancement. This is determined by cutter diameter, pick spacing, angle, speed of cutter rotation and rate of machine advancement. Cutting system parameters (cutter rotation speed, cut depth, advancement speed) can be manually or automatically controlled. In some embodiments, interlocking may be provided as a safety measure to prevent stalling of cutting operations and potential damage to the machines. In alternative embodiments, particle size may be controlled by a crusher or sizing device integrated within the BM.

Additional digging lines for the BM 112 and vehicle manoeuvring turns can be undertaken manually or by means of automated routines. Automation of the cutting is preferably maximised, and to this end a control system of the PSV 106 has the capability to incorporate automatic feedback control integrated into a mine model such that operating parameters such as cutting rate, recovered ore grade, rock hardness and particle size learned from overlying benches can be automatically used to control mining of subsequent underlying benches.

Overall, the aim of the cutting sequence is to maximise production rate and deliver stockpiles of cut ore on the seafloor. Once cut and left on the seafloor, the ore is then gathered by any suitable means, preferably by a separate gathering machine (GM) 114.

Figure 3:
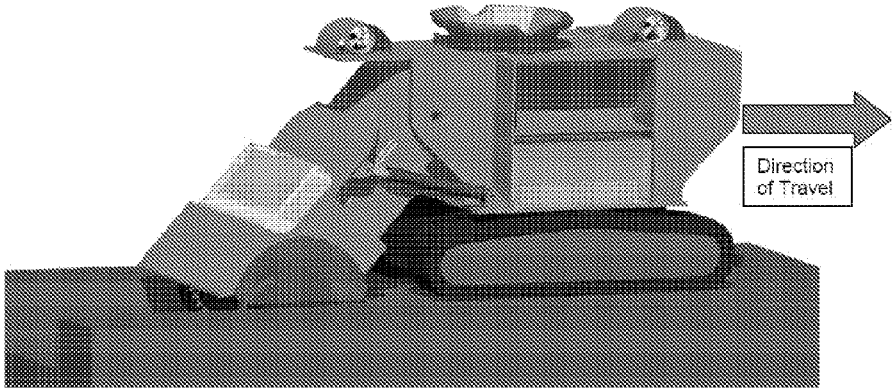
FIG. 3 is a perspective view representation of a bulk miner having a single cutter drum in accordance with another embodiment of the present invention.
Figure 4:
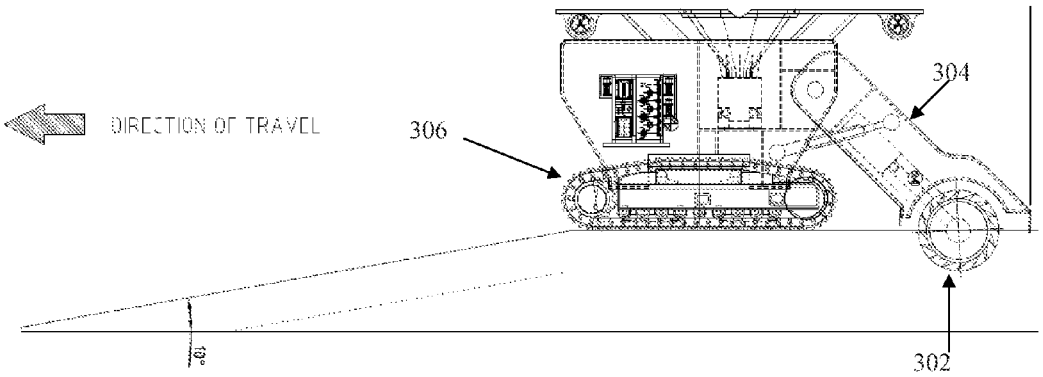
FIG. 4 is an elevation view of a bulk miner in accordance with a similar embodiment of the invention.

The seafloor vehicle 112 for bulk mining, cutting and excavating material is described in more detail below with reference to FIGS. 3 and 4. The seafloor mining tool 112 of the embodiment provides an ore cutting/sizing function. Control systems on board the PSV ensure efficient optimisation of SMT operations whilst maximising a safe working area between machines, umbilicals and lift wires to ensure continuous operation. FIG. 3 is a perspective view representation of a BM in accordance with an embodiment of the present invention. FIG. 4 is an elevation view of a bulk miner in accordance with a similar embodiment of the invention.

As outlined in FIG. 3 and FIG. 4, the BM is a high production cutting machine which is intended for the excavation of the target ore in preparation for pumping as a slurry to the PSV. The system incorporates an electrically driven cutting drum assembly 302 positioned at the rear of the vehicle 112. The cutter drum assembly 302 is mounted on a boom assembly 304 capable of lifting and lowering the cutting drum assembly 302. The cutter drum 302 is designed to cut a bench of up to 4 m in depth in multiple passes, leaving fragmented material in place in a uniform distribution. The fragmented material suitably has a particle size distribution suiting slurry transfer parameters and the topside recovery process. The cutting drum may be required to operate in either overcut or undercut modes. In alternative embodiments, the cutting drum assembly may be hydraulically driven.

A tracked locomotion system 306 is capable of propelling the vehicle 112 in a forward direction whilst the cutting drum 302 is engaged in cutting rock or ore. After cutting, the cut ore is simply left and remains on the seafloor, where it is left to be recovered and delivered to the RALS pumping system 118—suitably by the seafloor gathering machine (GM) 114. The primary function of the BM 112 is thus to cut and size a bench of 4 m depth in multiple or single passes, and to serve as a high production horizontal cutting machine. The BM is thus a heavy tracked machine with low centre of gravity to maximise power delivery to the rock or ore bearing body. The machine of the embodiment delivers about 900 kW to the rock face, and requires a total machine power of between 2 MW and 3 MW.

Figure 5:
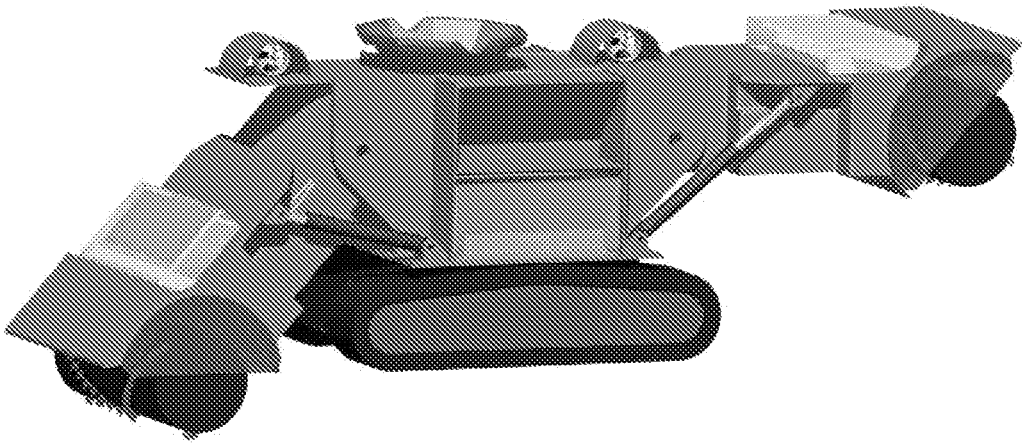
FIG. 5 is a perspective view representation of a bulk miner having two cutter drums in accordance with a further embodiment of the present invention.

In an alternative embodiment shown in FIG. 5, the bulk miner incorporates two boom mounted cutting drums, one at each end of the vehicle. In this embodiment, the vehicle does not need to be turned around at the end of each pass across the bench, as it is possible to instead simply engage whichever cutting drum is trailing the vehicle. In the embodiments of FIGS. 3 to 5, the cut width is greater than the machine track width.

Figure 6:
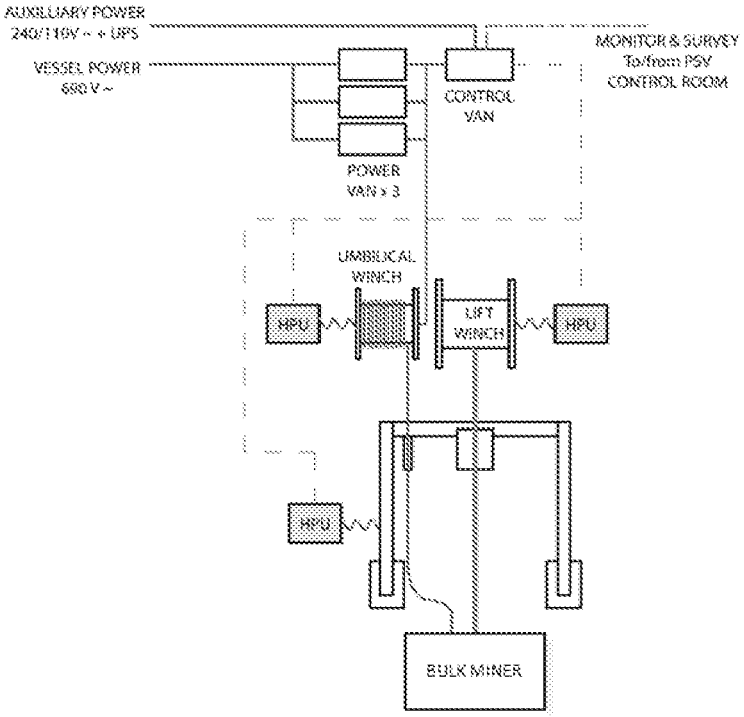
FIG. 6 is a schematic outlining the bulk mining machine deployment and operational system.

The bulk mining machine deployment and operational system is outlined in FIG. 6. Here, the Production Support Vessel (PSV) 106 hosts a control room from which the BM 112 is operated, along with the winches for both umbilical and lift wire, along with an A Frame for deployment and recovery of the BM 112. The BM 112 is connected to the vessel 106 by means of an umbilical cable, and a main hoist wire. The umbilical cable provides electrical power to drive the track drive motors, hydraulic system drive motors(s), and cutter system drive motor(s). The umbilical also provides multiplexed fibre optic communication links between the BM 112 and the operational control room.

The BM 112 is lowered from the PSV 106 to the seafloor, via a main hoist wire. When the BM 112 is landed on the seafloor, the hoist wire can be disconnected and recovered either back to the PSV 106, or to a safe height whereby it will not get tangled with the umbilical during bench cutting operations. When the BM 112 is ready to be recovered to the PSV 106, the hoist wire can be reconnected.

During cutting operations, the cutter drum 302 is lowered, and a force applied to the rock face depending on its hardness and desired fragmentation rate during cutting. The vehicle tracks forward and the cutting drum 302 cuts at a controlled rate and force. Automatic routines are in place to maintain a constant cutting force with the boom 304 force and track tramming speed being automatically adjusted with variations in cutting force requirements. Ore is cut and ground in one pass to a bench depth up to 4 m in single or multiple passes. The BM 112 follows a plan developing strips of cut ore until the site or bench is fully cut to a single pass of cutter depth, then the gathering of ore by a separate machine occurs.

At the end of a cut line, the BM configured with a dual cutter drum arrangement as shown in FIG. 5 will raise the rear cutter drum, manoeuvre onto the next cut line (in parallel with the line that has just been completed), lower the forward cutter drum, and continue operations (this time effectively in reverse so that the cutter boom is always at the rear of the direction of travel).

The BM configured with a single cutter drum as shown in FIGS. 3 and 4, the vehicle will raise the drum 302, and turn substantially 180 degrees to begin a new cut line.

A water jet system may optionally be installed in BM 112 to provide cleaning of the cutter drum picks in the event they are clogged, and flushing of the vehicle tracks in the event they get covered in material.

FIGS. 7*a* and 7*b* illustrate a bulk cutter 700 in accordance with another embodiment of the invention. Bulk cutter 700 comprises an electrically driven cutting drum assembly 702 positioned at the front of the vehicle 700. The cutter drum assembly 702 is mounted on a boom assembly 704 which is capable of lifting and lowering the cutting drum assembly 702. The cutter drum assembly 702 is designed to cut a bench of up to 4 m in depth in multiple passes. A sizing grill 708 is provided adjacent the cutting drum 702 and is mounted on the boom assembly 704, although in alternative embodiments the grill 708 may be mounted on the vehicle chassis similarly as for spade 710. The sizing grill sizes cuttings as they are produced by the drum 702, to a size suitable for transport in slurry form. A spade 710 separates cuttings from the seabed as the tool 700 moves forward, and an auger 712 urges cuttings within spade 710 towards a suction inlet, not visible in FIG. 7 but shown generally at 714.

Bulk cutter 700 thus cuts, sizes and sucks up cuttings in a single process. Cuttings captured by the suction inlet 714 in this embodiment are pumped via transfer pipe to a selected seafloor stockpiling location.

The embodiment of FIG. 7 recognises the particular benefit of using a suction inlet 714 to capture cuttings which comprise a significant proportion of fine and small particles. In water such particles are inefficiently captured by mechanical means whereas a suitably configured and operated slurry inlet presents an efficient method for gathering cuttings of all sizes produced by the cutting drum 702. Containment and capture of cuttings is aided by collection shroud 716.

While the embodiment of FIG. 7 comprises a suction inlet alternative embodiments such as those of FIGS. 3 and 5 may omit such a suction inlet.

Figure 8A:
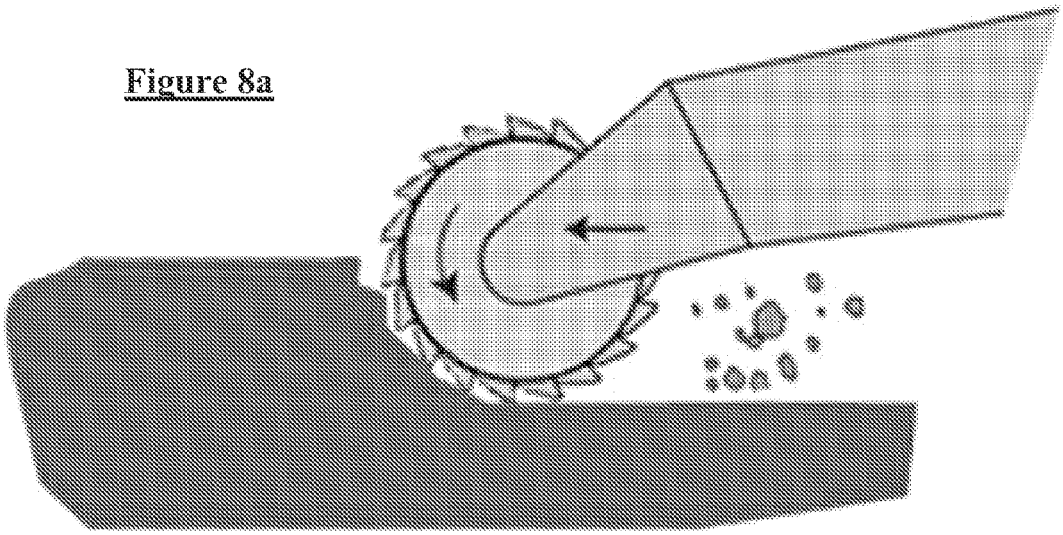
FIGS. 8*a* and 8*b* illustrate overcutting and plunge cutting, respectively.
Figure 8B:
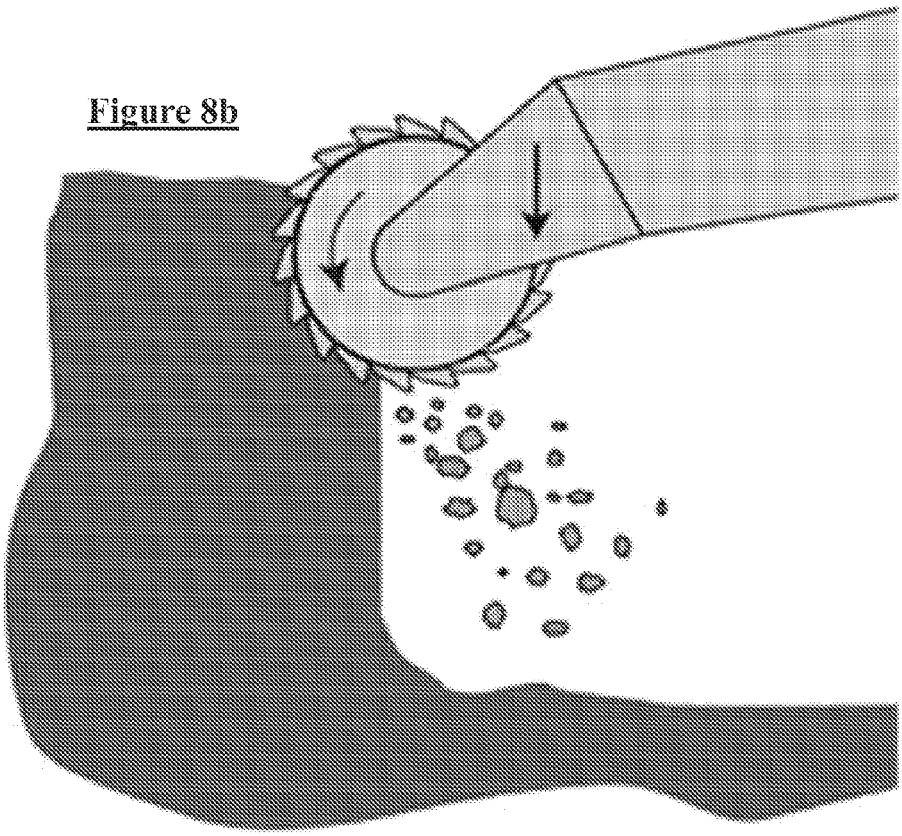

The bulk cutler of some embodiments of the invention may undertake overcutting, in which the cutting drum is forward of, and at a fixed height relative to, the tool 700, and the tool travels across the bench, as shown in FIG. 8*a*. In some embodiments such as shown in FIG. 8*b*, the bulk cutter may be used in a plunging mode, in which the machine is stationary during cutting and the cutting drum is lowered down a wall while cutting the wall, up to about 4 m high and to a cutting depth up to about half the diameter of the cutting drum. After each such plunge cut the machine then travels forward by the depth of the cut and performs another plunge cut.

It is to be appreciated that particular terms used herein may be synonymous with other terms which equally describe the present invention and the scope of the present application is thus not to be limited to any one such synonym. For example, seafloor mining tools may also be referred to as subsea machines, a production support vessel may be referred to as a surface vessel and/or surface facilities, ore may be equally or alternatively referred to as rock, consolidated sediment, unconsolidated sediment, soil, seafloor material, and mining may comprise cutting, dredging or otherwise removing material.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A seafloor bulk mining tool for production cutting of a seafloor bench, the bulk mining tool comprising:

a tracked locomotion system to enable locomotion of the bulk mining tool across the seafloor bench;

power and control interfaces to receive power and control signals from a surface source;

a cutting drum for cutting the seafloor bench; and a sizing grill adjacent the cutting drum, for sizing cuttings as they are produced by the cutting drum.

2. The tool of claim 1 further comprising a slurry pump system and a slurry inlet proximal to the cutting drum, configured to capture the cuttings from the proximity of the sizing grill in the form of a slurry.

3. The tool of claim 2 wherein the slurry pump system is configured to pump the slurry to one side of a path taken or to be taken by the tool.

4. The tool of claim 2 wherein the slurry pump system is configured to pump the slurry to a seafloor stockpile location via a suitable transfer pipe.

5. The tool of claim 2 further comprising a collection shroud which partially surrounds the cutting drum to improve containment and collection of the cuttings by the slurry pump system.

6. The tool of claim 1 wherein the sizing grill sizes the cuttings by crushing particles larger than a grill-to-drum distance against the cutting drum.

7. The tool of claim 1 wherein the cutting drum is mounted on a boom assembly allowing cutting drum retraction and variable cutting depth.

8. The tool of claim 7 wherein the sizing grill is mounted on the boom assembly.

9. The tool of claim 1 wherein a drum cut width is greater than a machine track width.

10. The tool of claim 1, further comprising a suction inlet to capture the cuttings from the sizing grill.

11. The tool of claim 1, further comprising a spade immediately aft of the cutting drum to separate the cuttings from the seafloor.

12. The tool of claim 11 further comprising one or more augers within the spade to urge the cuttings within the spade towards a suction inlet.

13. A method for production cutting of a seafloor bench, the method comprising:

a seafloor bulk mining tool receiving power and control signals from a surface source;

the seafloor bulk mining tool locomoting across the seafloor bench; and a cutting drum of the seafloor bulk mining tool cutting the seafloor bench, and a sizing grill adjacent the cutting drum sizing cuttings as they are produced by the cutting drum.

14. The method of claim 13, wherein when the material to be retrieved is of a thickness greater than a bench height, the bench height being defined by the cutting depth of the seafloor bulk mining tool, multiple layers of benches of the material are removed by multiple passes by the bulk mining tool.

15. The method of claim 14, wherein the cuttings produced by each of the multiple passes of the seafloor bulk mining tool are gathered by a suction inlet of the bulk mining tool during each of the multiple passes.

16. The method of claim 13, wherein the seafloor bulk mining tool cuts substantially the entire seafloor bench by traversing the surface of the seafloor bench in one or more cutting paths, the one or more cutting paths optimised to maximise ore recovery from the seafloor bench based on seafloor bench size and seafloor bench shape.

17. The method of claim 13 wherein the cutting drum is positioned ahead of the tool, and undertakes overcutting of the bench.

18. The method of claim 13 wherein the cutting drum is positioned aft of the tool, and undertakes undercutting of the bench.

19. The method of claim 13 wherein the cutting drum is positioned ahead of the tool, and undertakes plunge cutting of the bench.

* * * * *